US011009043B2

(12) United States Patent
Kim

(10) Patent No.: US 11,009,043 B2
(45) Date of Patent: May 18, 2021

(54) TURBO COMPRESSOR INCLUDING INTERCOOLER

(71) Applicant: TNE KOREA CO., LTD., Daejeon (KR)

(72) Inventor: Kyeong Su Kim, Daejeon (KR)

(73) Assignee: TNE KOREA CO., LTD., Daejeon (KR)

( * ) Notice: Subject to any disclaimer, the term of this patent is extended or adjusted under 35 U.S.C. 154(b) by 166 days.

(21) Appl. No.: 16/078,100

(22) PCT Filed: Nov. 7, 2017

(86) PCT No.: PCT/KR2017/012554
§ 371 (c)(1),
(2) Date: Aug. 21, 2018

(87) PCT Pub. No.: WO2018/097511
PCT Pub. Date: May 31, 2018

(65) Prior Publication Data

US 2019/0048893 A1 Feb. 14, 2019

(30) Foreign Application Priority Data

Nov. 22, 2016 (KR) ..... 10-2016-0156061

(51) Int. Cl.
*F04D 29/58* (2006.01)
*F04D 17/12* (2006.01)
(Continued)

(52) U.S. Cl.
CPC ..... *F04D 29/584* (2013.01); *F04D 17/12* (2013.01); *F04D 25/0606* (2013.01); *F04D 29/5806* (2013.01); *F04D 29/444* (2013.01)

(58) Field of Classification Search
CPC ..... F04D 25/082; F04D 25/06–0606; F04D 25/16; F04D 29/5806–5833; F04D 29/584; F04D 17/12; F04D 17/122; F04D 29/444
(Continued)

(56) References Cited

U.S. PATENT DOCUMENTS 6,764,279 B2 7/2004 Meshenky
2015/0171689 A1* 6/2015 Wada ..... F04D 29/5806 417/423.7
(Continued)

FOREIGN PATENT DOCUMENTS

JP S51-035110 A 3/1976
KR 10-2001-0010014 A 2/2001
(Continued)

*Primary Examiner* — Alexander B Comley
(74) *Attorney, Agent, or Firm* — KORUS Patent, LLC; Seong Il Jeong

(57) ABSTRACT

Provided is a turbo compressor for compressing a gas such as air and supplying the compressed gas to outside, the turbo compressor including a compression gas inlet for sucking the gas, a first impeller, a second impeller, a compression gas outlet for discharging to outside, a compression unit including compression gas channels connected from the compression gas inlet to the compression gas outlet, a motor to rotate the first and second impellers, and including a rotary shaft, a housing including a motor accommodation space, and an intercooler including air-cooling channels provided on the compression gas channels located between the first and second impellers, wherein the air-cooling channels penetrate through and are hidden in the housing. According to the present invention, the turbo compressor's size may be reduced by integration of the intercooler and the housing, and damage of the intercooler due to external impact may be prevented.

6 Claims, 9 Drawing Sheets

(51) Int. Cl.
*F04D 25/06* (2006.01)
*F04D 29/44* (2006.01)

(58) Field of Classification Search
USPC ..... 417/243, 368, 369
See application file for complete search history.

(56) References Cited

U.S. PATENT DOCUMENTS

| | | | | |
|---|---|---|---|---|
| 2015/0308456 | A1* | 10/2015 | Thompson | H02K 9/00 417/244 |
| 2016/0032931 | A1 | 2/2016 | Lee | |
| 2017/0328269 | A1* | 11/2017 | Yamashita | F01P 7/14 |

FOREIGN PATENT DOCUMENTS

| | | | |
|---|---|---|---|
| KR | 10-2013-0030392 | A | 3/2013 |
| KR | 10-2013-0139076 | A | 12/2013 |
| KR | 10-2016-0014376 | A | 2/2016 |

* cited by examiner

TURBO COMPRESSOR INCLUDING INTERCOOLER

TECHNICAL FIELD

The present invention relates to a turbo compressor, and more particularly, to a turbo compressor capable of being used for various purposes by reducing an overall product size based on integration of an intercooler and a housing, and of preventing damage of the intercooler due to external impact.

BACKGROUND ART

A turbo compressor or turbo blower is a centrifugal pump for sucking and compressing external air or gas and then providing the compressed air or gas to outside by rotating an impeller at a high speed, and is commonly used for powder transfer or for aeration at sewage treatment plants and is also currently used for industrial processes and for vehicles.

To produce a high-pressure compressed gas, a single-stage compression scheme using a single impeller and a multi-stage compression scheme using two or more impellers connected in series are usable.

When a single-stage compression scheme is used, an available maximum pressure of a compressed gas is about 3 to 4 bars, and a smaller compressor achieves a lower maximum pressure of a compressed gas. Furthermore, since a very high rotation speed is required due to a design factor such as a specific speed, the speeds of a motor and inverter for rotating the impeller also need to be increased. In addition, loss due to windage loss is rapidly increased on the surface of bearings or a rotor and thus a reduction in overall energy efficiency is unavoidable.

To solve the above-described problems, a two-stage compression scheme for compressing a gas in two stages by connecting two impellers in series may be used. In this case, although an available maximum pressure of the compressed gas is increased, since the temperature of the compressed gas is increased due to "adiabatic compression" and thus efficiency of the second-stage impeller is reduced, to solve this problem, a cooling device such as an intercooler is mounted between the first-stage impeller and the second-stage impeller for "isothermal compression". When the multi-stage compression scheme is used as described above, since a compression ratio of each impeller is reduced and a rotation speed due to a specific speed is also reduced, various technical problems of the single-stage compression scheme may be solved.

An example of a known two-stage turbo compressor is disclosed in KR 10-2001-0010014. This turbo compressor includes an intercooler that is a heat exchange device for cooling high-temperature compressed air to about 40° C. or below.

However, as illustrated in FIG. 2 of KR 10-2001-0010014, the known intercooler is separately provided outside a housing surrounding a first impeller and a second impeller, to increase cooling efficiency, and is generally produced as a quite large-sized cooling device to increase cooling efficiency.

Therefore, the known two-stage turbo compressor requires a high production cost, requires a large installation space due to a large product size, and thus is usable for a limited purpose.

DETAILED DESCRIPTION OF THE INVENTION

Technical Problem

The present invention provides an enhanced turbo compressor capable of being used for various purposes by reducing an overall product size based on integration of an intercooler and a housing, and of preventing damage of the intercooler due to external impact.

Technical Solution

According to an aspect of the present invention, there is provided a turbo compressor for compressing a gas such as air and supplying the compressed gas to outside, the turbo compressor including a compression gas inlet for sucking the gas, a first impeller for primarily compressing the gas sucked through the compression gas inlet, a second impeller for secondarily compressing the gas compressed by the first impeller, a compression gas outlet for discharging the gas compressed by the second impeller, to outside, a compression unit including compression gas channels connected from the compression gas inlet to the compression gas outlet, a motor having an end coupled to the first impeller and another end coupled to the second impeller to rotate the first and second impellers, and including a rotary shaft extending along a first central axis, a housing including a motor accommodation space to accommodate the motor, and an intercooler including air-cooling channels through which the gas flows, and provided on the compression gas channels located between the first and second impellers, wherein the air-cooling channels penetrate through and are hidden in the housing.

The air-cooling channels may be generated in a helical shape around the first central axis.

Guide members for guiding directions of flow of the gas compressed by the first impeller may be provided at an upstream side of the air-cooling channels.

The housing may include an inner housing including the motor accommodation space, and an outer housing surrounding the inner housing, and the air-cooling channels may be provided between an outer surface of the inner housing and an inner surface of the outer housing.

The turbo compressor may further include a water-cooling channel for circulating a cooling liquid to cool the housing.

The water-cooling channel may include water channels penetrating through the housing to cool the housing.

The water-cooling channel may be provided to exchange heat with the gas contained in the air-cooling channels.

The air-cooling channels may be positioned at an outer side of the water-cooling channel in radial directions of the first central axis.

Cooling fins capable of increasing heat exchange efficiency may be provided between the water-cooling channel and the air-cooling channels.

The water-cooling channel may include a plurality of unit water channels extending along the first central axis and spaced apart from each other along a circumferential direction of the first central axis, a plurality of rear water channels for connecting rear ends of the unit water channels, and a plurality of front water channels for connecting front ends of the unit water channels, and may be generated in a zigzag shape.

Advantageous Effects

According to the present invention, a turbo compressor includes a compression gas inlet for sucking a gas, a first impeller for primarily compressing the gas sucked through the compression gas inlet, a second impeller for secondarily compressing the gas compressed by the first impeller, a compression gas outlet for discharging the gas compressed by the second impeller, to outside, a compression unit including compression gas channels connected from the compression gas inlet to the compression gas outlet, a motor having an end coupled to the first impeller and another end coupled to the second impeller to rotate the first and second impellers, and including a rotary shaft extending along a first central axis, a housing including a motor accommodation space to accommodate the motor, and an intercooler provided on the compression gas channels located between the first and second impellers, and including air-cooling channels through which the gas flows, wherein the air-cooling channels airtightly penetrate through and are hidden in the housing. As such, the turbo compressor may be used for various purposes by reducing an overall product size based on integration of the intercooler and the housing, and may prevent damage of the intercooler due to external impact.

BEST MODE

Hereinafter, the present invention will be described in detail by explaining embodiments of the invention with reference to the attached drawings.

Figure 1:
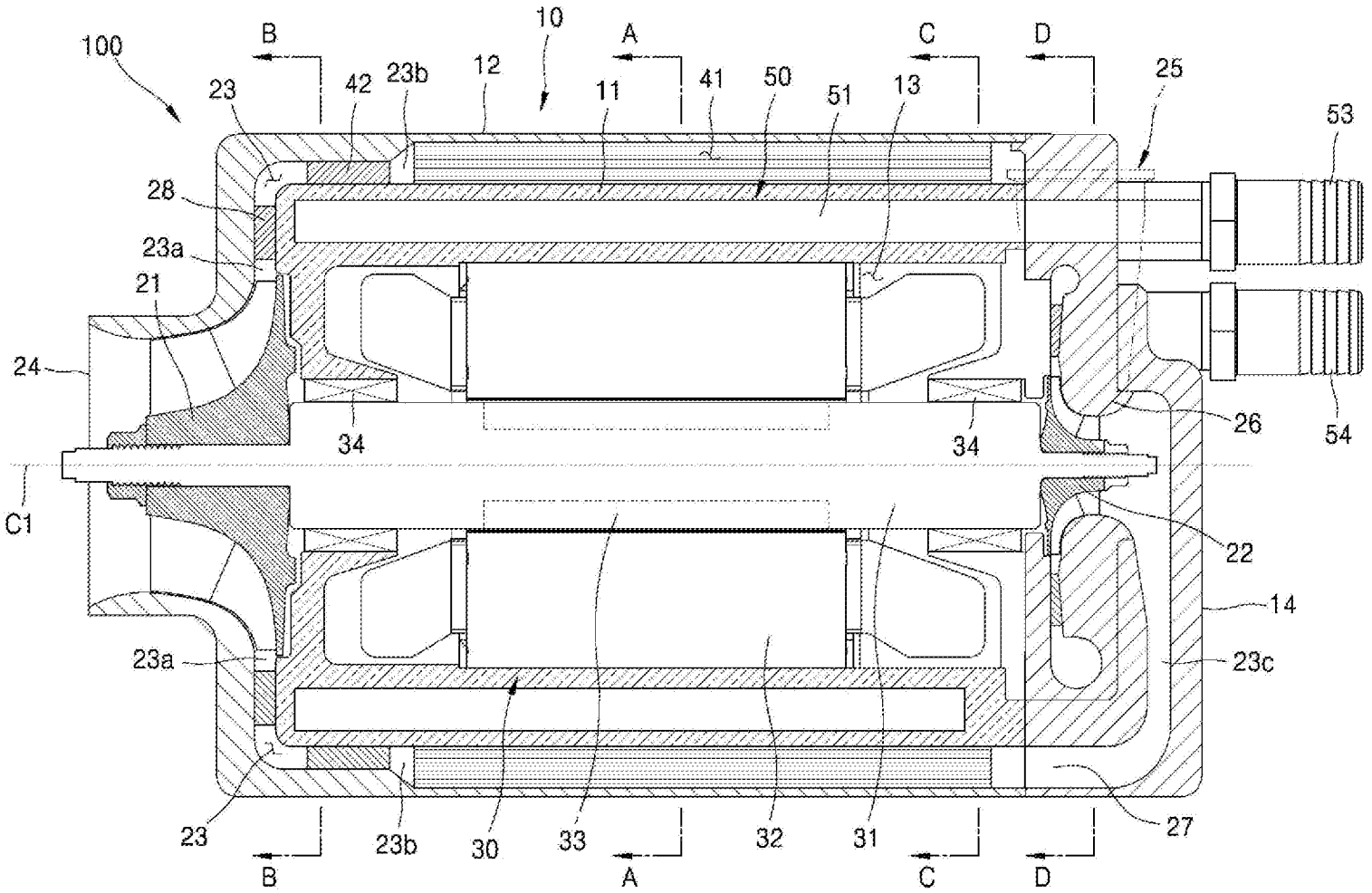
FIG. 1 is a cross-sectional view of a turbo compressor according to an embodiment of the present invention.
Figure 2:
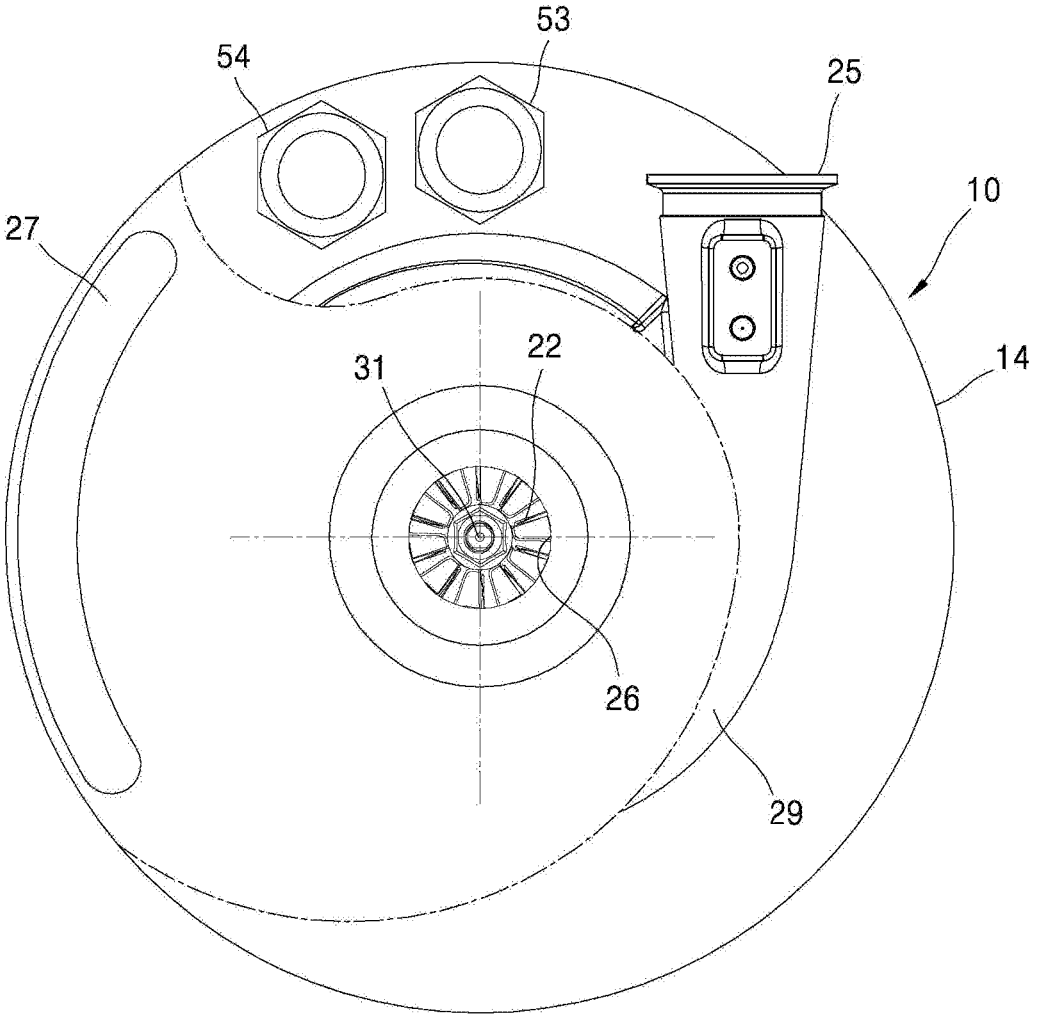
FIG. 2 is a partially-cut right side view of the turbo compressor illustrated in FIG. 1.
Figure 3:
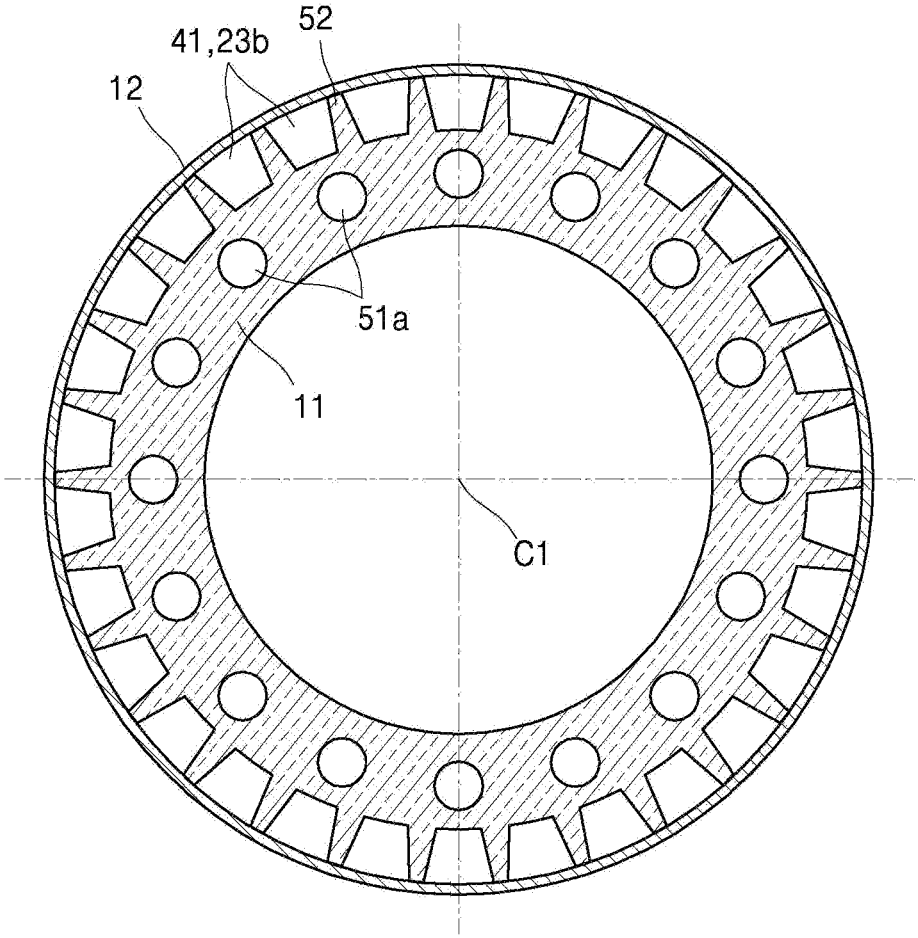
FIG. 3 is a cross-sectional view of the turbo compressor cut along line A-A of FIG. 1.

FIG. 1 is a cross-sectional view of a turbo compressor 100 according to an embodiment of the present invention, and FIG. 2 is a partially-cut right side view of the turbo compressor 100 illustrated in FIG. 1. FIG. 3 is a cross-sectional view of the turbo compressor 100 cut along line A-A of FIG. 1.

Referring to FIGS. 1 to 3, the turbo compressor 100 according to an embodiment of the present invention is a centrifugal pump for sucking and compressing an external gas and then providing the compressed gas to outside by rotating an impeller at a high speed, and is also called a turbo compressor or a turbo blower. The turbo compressor 100 includes a housing 10, a compression unit, a motor 30, an intercooler, and a water-cooling unit 50. In the following description, it is assumed that the gas to be compressed is air.

The housing 10 is a housing made of a metal material, and includes an inner housing 11, an outer housing 12, a motor accommodation space 13, and a rear housing 14.

The inner housing 11 is a cylindrical member including the motor accommodation space 13 therein, has a circular cross-section around a first central axis C1, and extends along the first central axis C1.

The motor accommodation space 13 is a space having a shape corresponding to the motor 30 to be described below, to accommodate the motor 30.

The inner housing 11 has an open left end (or front end) and an open right end (or rear end) as illustrated in FIG. 1.

The outer housing 12 is a cylindrical member having a circular cross-section around the first central axis C1, and extends along the first central axis C1.

The outer housing 12 has a shape corresponding to the inner housing 11, to surround and accommodate the inner housing 11.

An inner surface of the outer housing 12 and an outer surface of the inner housing 11 are spaced apart from each other by a preset distance to face each other.

A portion of a side wall of the outer housing 12 facing the intercooler may be generated as thinly as possible.

The rear housing 14 is a housing made of a metal material and capable of airtightly closing rear ends of the inner and outer housings 11 and 12.

The rear housing 14 may be produced in separate pieces to be mounted on the motor 30, and a detailed description thereof will not be provided herein.

The rear housing 14 includes a scroll 29 having a channel through which the air having passed through a second impeller 22 flows in a vortex shape, as illustrated in FIG. 2.

The scroll 29 connects the second impeller 22 to a compression gas outlet 25.

The rear housing 14 is coupled to the inner and outer housings 11 and 12 by a bolt or a screw.

The compression unit is a device for sucking and compressing the external air, and includes a first impeller 21, the second impeller 22, and compression gas channels 23.

The first impeller 21 is a wheel for sucking and primarily compressing the external air, and includes a plurality of blades having curved surfaces and is mounted to be rotatable at a high speed.

The first impeller 21 is positioned between left ends of the inner and outer housings 11 and 12.

In front of the first impeller 21, a compression gas inlet 24 for sucking the external air is generated in the outer housing 12.

The second impeller 22 is a wheel for secondarily compressing the gas primarily compressed by the first impeller 21, and, like the first impeller 21, includes a plurality of blades having curved surfaces and is mounted to be rotatable at a high speed.

The second impeller 22 is positioned between the right end of the inner housing 11 and the rear housing 14.

Behind the second impeller 22, an intermediate compression gas inlet 26 for receiving the gas primarily compressed by the first impeller 21 is generated in the rear housing 14.

In the rear housing 14, an intermediate compression gas outlet 27 for discharging the gas primarily compressed by the first impeller 21 is generated as illustrated in FIG. 2.

Figure 8:
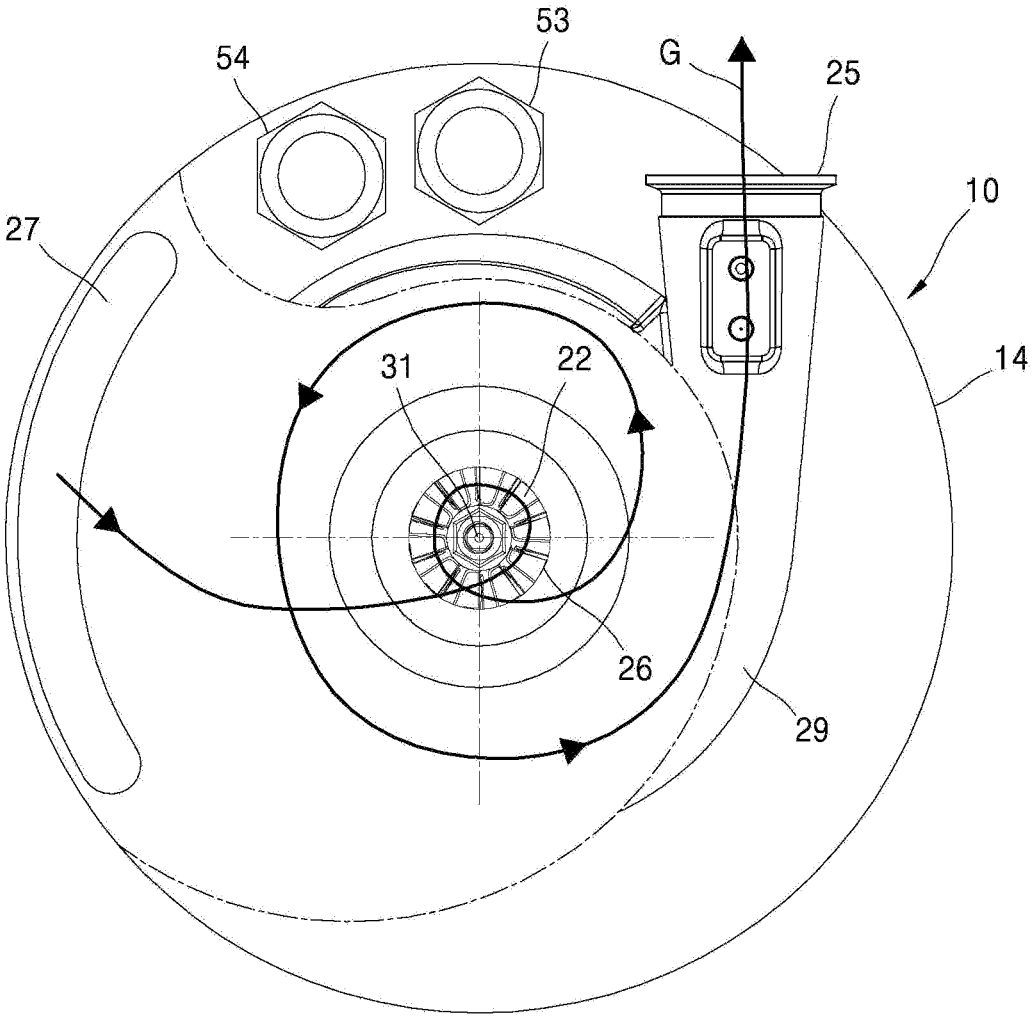
FIG. 8 is a partially-cut right side view showing the flow of the compressed gas in the turbo compressor illustrated in FIG. 2.

The air G discharged from the intermediate compression gas outlet 27 flows through the intermediate compression gas inlet 26 into the second impeller 22 as illustrated in FIG. 8.

The compression gas channels 23 are air channels connected from the compression gas inlet 24 to the compression gas outlet 25.

The air sucked into the compression gas inlet 24 is compressed while moving along the compression gas channels 23 connected from the compression gas inlet 24 to the compression gas outlet 25.

Figure 7:
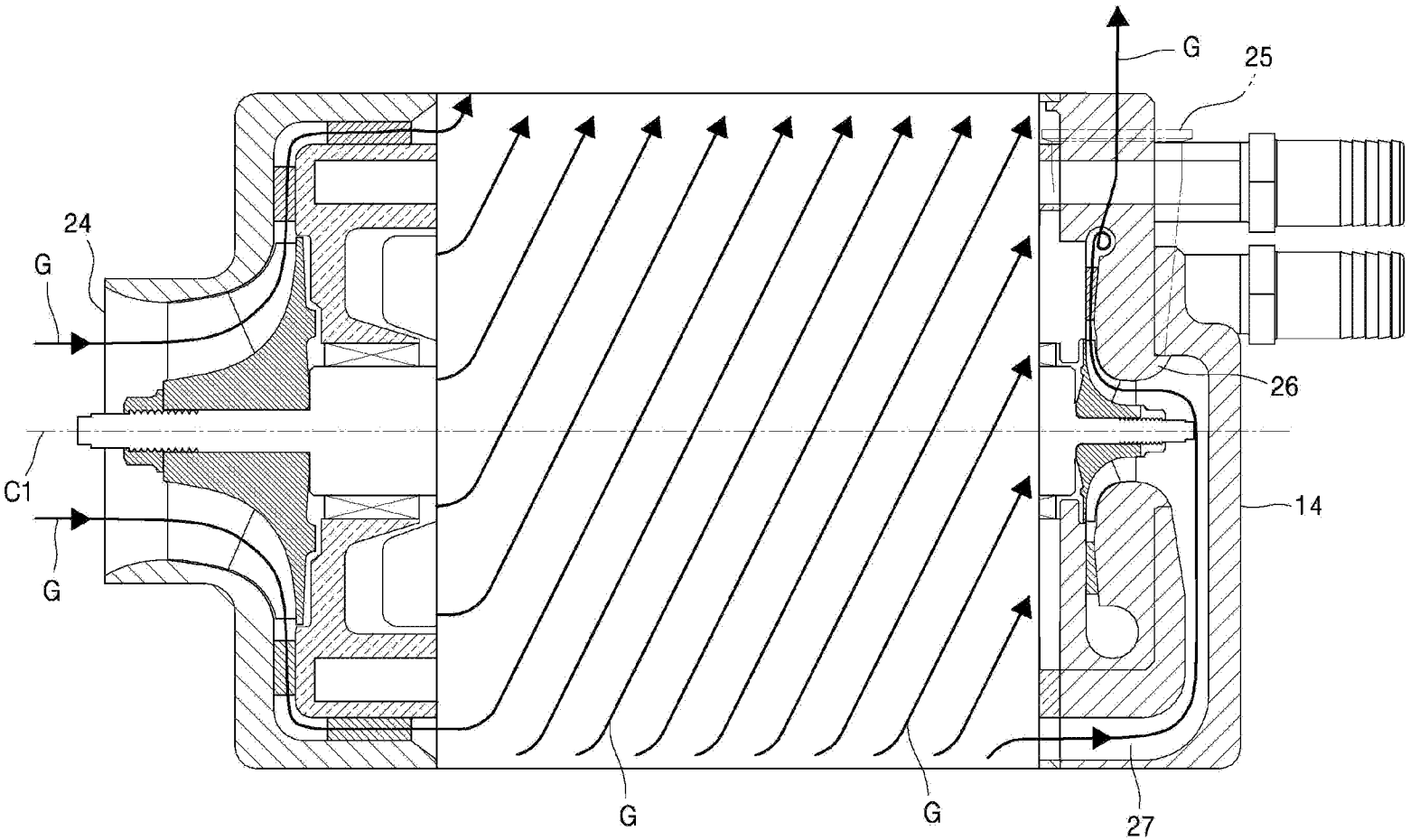
FIG. 7 is a cross-sectional view showing the flow of a compressed gas in the turbo compressor illustrated in FIG. 1.

The compression gas channels 23 are connected from the compression gas inlet 24 sequentially through the first impeller 21, the intercooler, the intermediate compression gas outlet 27, the intermediate compression gas inlet 26, and the second impeller 22 to the compression gas outlet 25 as illustrated in FIG. 7.

The compression gas channels 23 include front air channels 23*a*, middle air channels 23*b*, and rear air channels 23*c*.

The front air channels 23*a* are air channels for allowing the air to flow from the center toward the edge of a front end of the housing 10.

The front air channels 23*a* are a plurality of air channels defined by a diffuser 28, and extend along radial directions of the first central axis C1.

The middle air channels 23*b* are a plurality of air channels penetrating through the housing 10 to cool the housing 10, and extend around and along the first central axis C1.

The middle air channels 23*b* are spaced apart from each other by a preset distance along a circumferential direction of the first central axis C1 as illustrated in FIGS. 3 and 7.

The rear air channels 23*c* are connection air channels for allowing the air to flow from the middle air channels 23*b* into the intermediate compression gas inlet 26, and are generated at a rear end of the housing 10.

The front air channels 23*a* and the middle air channels 23*b* may be rotationally or axially symmetric with respect to the first central axis C1.

The air sucked into the compression gas inlet 24 may be compressed in two stages while moving along the compression gas channels 23 connected from the compression gas inlet 24 to the compression gas outlet 25.

The motor 30 is an electric motor for generating torque, and is a device for providing high-speed torque to the first and second impellers 21 and 22. The motor 30 includes a rotary shaft 31, a stator 32, a rotor 33, and bearings 34.

The rotary shaft 31 is a rod member extending along the first central axis C1, and a front end thereof is relatively non-rotatably coupled to the first impeller 21 and a rear end thereof is relatively non-rotatably coupled to the second impeller 22.

The stator 32 is a stator around which a field coil is wound, and is mounted and fixed in the motor accommodation space 13.

The rotor 33 is a rotor including a permanent magnet, and is coupled to a middle portion of the rotary shaft 31.

The bearings 34 are air bearings rotatably supporting the rotary shaft 31 to reduce friction generated due to high-speed rotation, and are separately provided at a front end and a rear end of the rotary shaft 31.

A preset gap is provided between the stator 32 and the rotor 33, between the rotary shaft 31 and the stator 32, and between the rotary shaft 31 and the bearings 34.

The intercooler is a device for cooling the air heated by the first impeller 21, and includes air-cooling channels 41 and guide members 42.

The air-cooling channels 41 are air channels which are located between the first and second impellers 21 and 22 and through which the air to be compressed flows. In the current embodiment, at least portions of the middle air channels 23*b* serve as the air-cooling channels 41.

The air-cooling channels 41 airtightly penetrate through and are hidden in the housing 10.

The air-cooling channels 41 are generated in a coil shape or a helical shape around the first central axis C1 as illustrated in FIG. 7.

The air-cooling channels 41 are generated by an outer circumferential surface of the inner housing 11, an inner circumferential surface of the outer housing 12, and surfaces of cooling fins 52 to be described below, as illustrated in FIG. 3.

The guide members 42 are members for guiding directions of flow of the air compressed by the first impeller 21, and a plurality of guide members 42 are provided at an upstream side of the air-cooling channels 41.

The guide members 42 are members for guiding the air having passed through the diffuser 28, to flow in preset directions before entering the air-cooling channels 41.

The guide members 42 are provided to have a preset angle with respect to the first central axis C1.

The water-cooling unit 50 is a device for cooling the housing 10 by using a cooling liquid, and includes a water-cooling channel 51, the cooling fins 52, a cooling liquid inlet 53, and a cooling liquid outlet 54. Herein, water is used as the cooling liquid.

The water-cooling channel 51 is a passage containing the cooling liquid to continuously circulate the cooling liquid.

Figure 4:
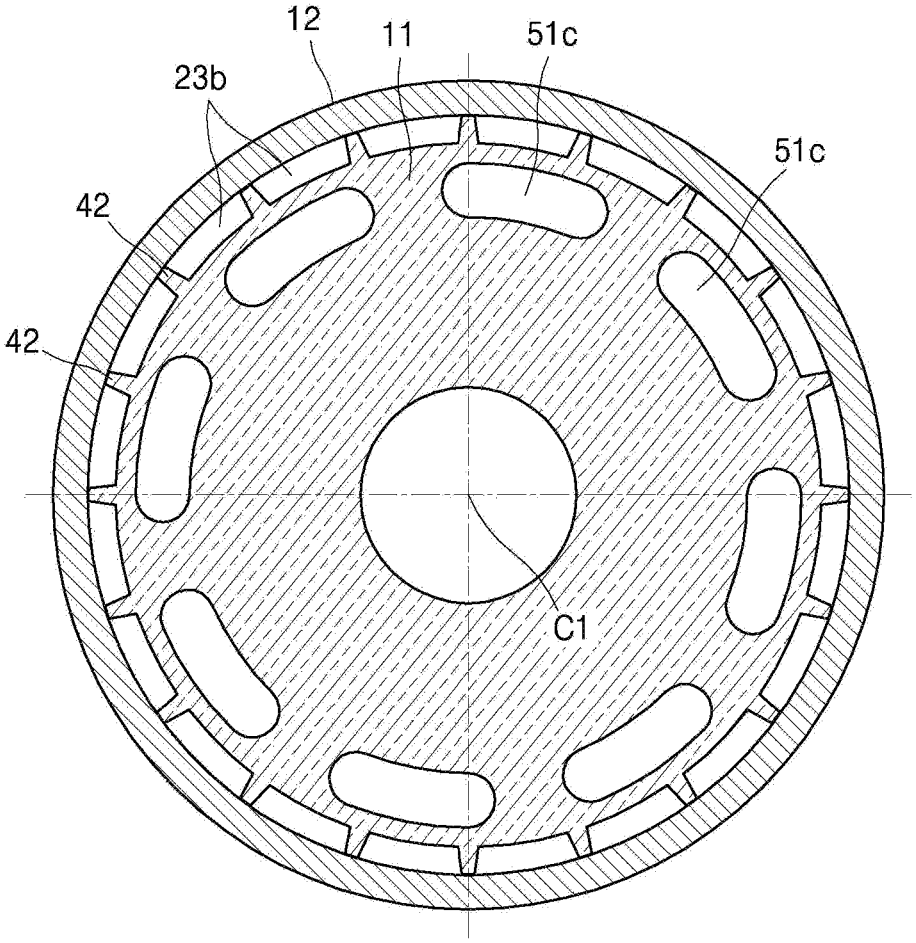
FIG. 4 is a cross-sectional view of the turbo compressor cut along line B-B of FIG. 1.

The water-cooling channel 51 penetrates through and is hidden in the inner housing 11 as illustrated in FIGS. 1 and 3, and includes unit water channels 51*a*, rear water channels 51*b* (see FIG. 5), and front water channels 51*c* (see FIG. 4).

The unit water channels 51*a* are water channels penetrating through and hidden in the inner housing 11 and having circular cross-sections, and linearly extend along the first central axis C1.

A plurality of unit water channels 51*a* are spaced apart from each other along the circumferential direction of the first central axis C1 as illustrated in FIG. 3.

Figure 5:
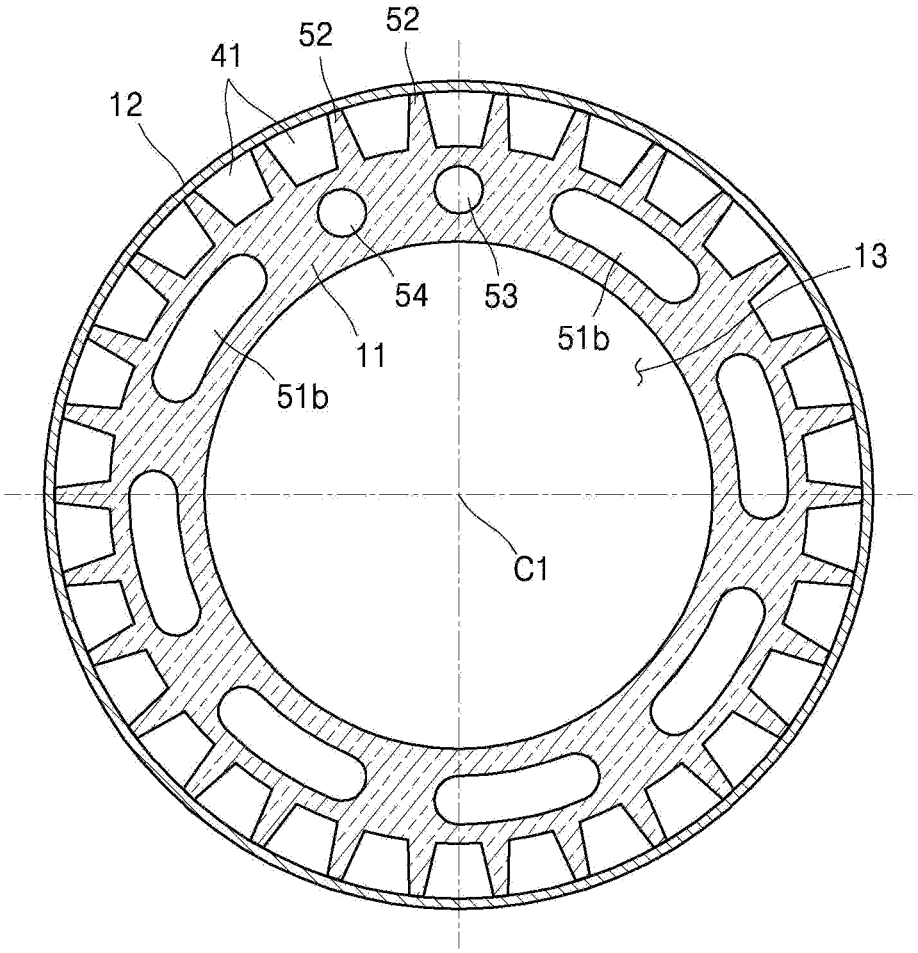
FIG. 5 is a cross-sectional view of the turbo compressor cut along line C-C of FIG. 1.
Figure 6:
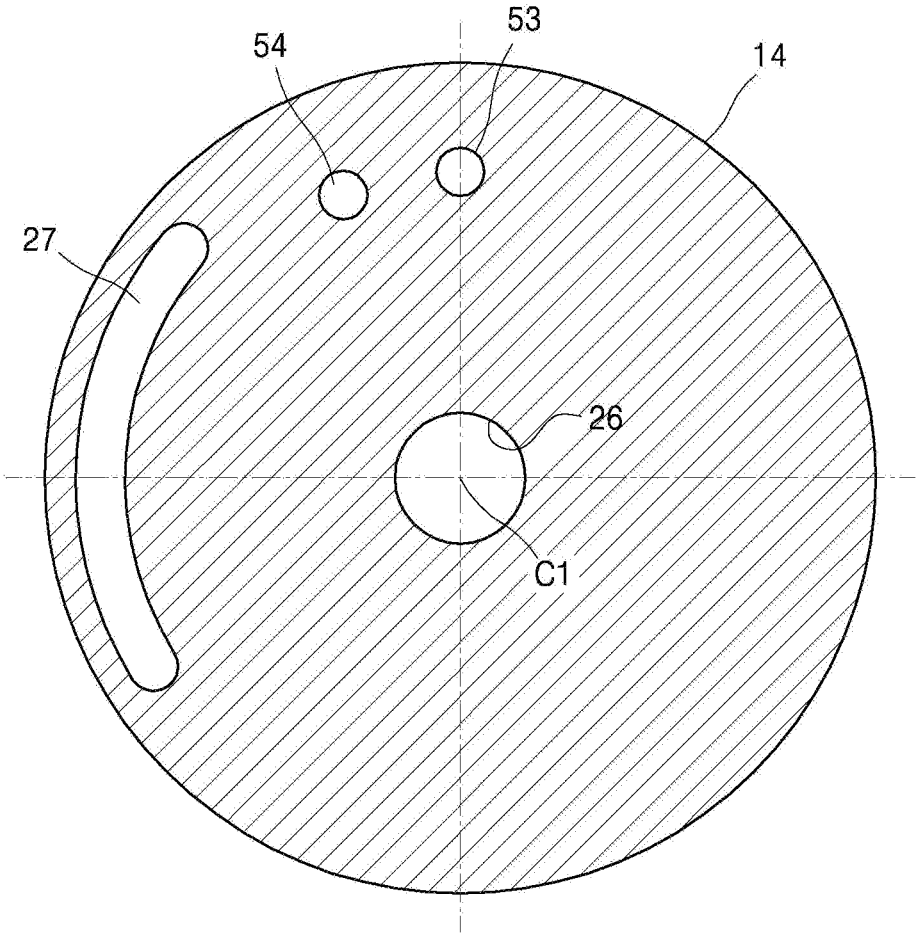
FIG. 6 is a cross-sectional view of the turbo compressor cut along line D-D of FIG. 1.

The rear water channels 51*b* are water channels for connecting rear ends of the unit water channels 51*a*, and penetrate through and are hidden in the rear end of the inner housing 11 as illustrated in FIG. 5.

The front water channels 51*c* are water channels for connecting front ends of the unit water channels 51*a*, and penetrate through and are hidden in the front end of the inner housing 11 as illustrated in FIG. 4.

Figure 9:
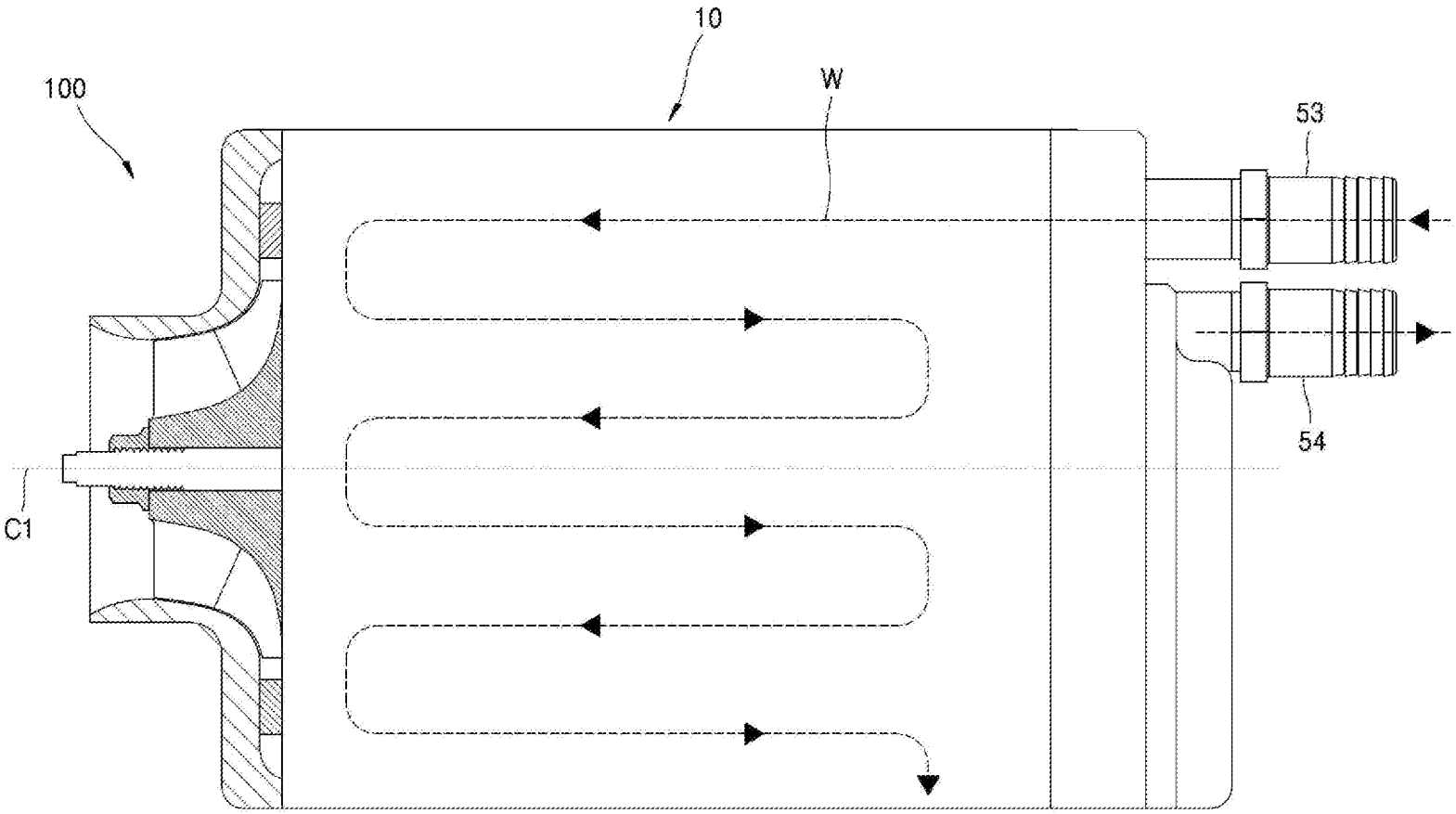
FIG. 9 is a cross-sectional view showing the flow of a cooling liquid in the turbo compressor illustrated in FIG. 1.

Therefore, the water-cooling channel 51 is generated along a circumferential direction of the inner housing 11 in a zigzag shape and is positioned to surround a whole side wall of the inner housing 11, as illustrated in FIG. 9.

The water-cooling channel 51 may be rotationally or axially symmetric with respect to the first central axis C1.

The water-cooling channel 51 may be positioned as close as possible to the air-cooling channels 41.

The water-cooling channel 51 are positioned at an inner side of the air-cooling channels 41 and thus is closer to the first central axis C1.

The cooling fins 52 are cooling fins for increasing heat exchange efficiency between the cooling liquid flowing along the water-cooling channel 51 and the air flowing along the air-cooling channels 41.

The cooling fins 52 protrude from the outer circumferential surface of the inner housing 11 in radial directions of the inner housing 11, and extend along the first central axis C1, as illustrated in FIGS. 1 and 3.

A plurality of cooling fins 52 are spaced apart from each other along the circumferential direction of the inner housing 11.

Ends of the cooling fins 52 are in contact with the inner surface of the outer housing 12.

The cooling liquid inlet 53 is an inlet for receiving the cooling liquid from outside, is connected to an end of the water-cooling channel 51, and is provided in the rear housing 14.

The cooling liquid inlet 53 is connected to an external pump (not shown), and thus receives water supplied from the pump.

The cooling liquid outlet 54 is an inlet for discharging the cooling liquid to outside, is connected to the other end of the water-cooling channel 51, and is provided in the rear housing 14.

The cooling liquid discharged from the cooling liquid outlet 54 may be cooled outside and then be supplied through the cooling liquid inlet 53 again.

An example of an operating method of the above-described turbo compressor 100 will now be described.

When the rotary shaft 31 of the motor 30 rotates, the first and second impellers 21 and 22 rotate at the same time, the air G sucked through the compression gas inlet 24 is compressed in two stages while sequentially flowing through the first impeller 21, the intercooler, and the second impeller 22, and is discharged to outside through the compression gas outlet 25.

The air discharged from the first impeller 21 is reduced in speed and is increased in pressure after passing through the diffuser 28, and is changed in directions of flow to an appropriate angle to enter the air-cooling channels 41, after passing through the guide members 42.

The air discharged from the guide members 42 are rapidly cooled through the air-cooling channels 41. In this case, since the air-cooling channels 41 are close to the water-cooling channel 51 and the outer housing 12, the air flowing through the air-cooling channels 41 may be cooled by the cooling liquid contained in the water-cooling channel 51 and by the air outside the outer housing 12 at the same time.

The cooling liquid contained in the water-cooling channel 51 is supplied from the cooling liquid inlet 53, flows along a cooling liquid path W in a zigzag shape along the circumferential direction of the inner housing 11 as illustrated in FIG. 9, cools both the inner and outer housings 11 and 12, and then is discharged through the cooling liquid outlet 54.

In this case, the air flowing through the air-cooling channels 41 is rapidly cooled by the cooling liquid flowing through the unit water channels 51*a* adjacent to the air-cooling channels 41. Particularly, by the cooling fins 52, heat exchange efficiency between the cooling liquid flowing through the unit water channels 51*a* and the air flowing through the air-cooling channels 41 is greatly increased.

The above-described turbo compressor 100 includes the compression gas inlet 24 for sucking the gas, the first impeller 21 for primarily compressing the gas sucked through the compression gas inlet 24, the second impeller 22 for secondarily compressing the gas compressed by the first impeller 21, the compression gas outlet 25 for discharging the gas compressed by the second impeller 22, to outside, the compression unit including the compression gas channels 23 connected from the compression gas inlet 24 to the compression gas outlet 25, the motor 30 having an end coupled to the first impeller 21 and the other end coupled to the second impeller 22 to rotate the first and second impellers 21 and 22, and including the rotary shaft 31 extending along the first central axis C1, the housing 10 including the motor accommodation space 13 to accommodate the motor 30, and the intercooler provided on the compression gas channels 23 located between the first and second impellers 21 and 22, and including the air-cooling channels 41 through which the gas flows, and the air-cooling channels 41 airtightly penetrate through and are hidden in the housing 10. As such, the turbo compressor 100 may be used for various purposes by reducing an overall product size based on integration of the intercooler and the housing 10, and may prevent damage of the intercooler due to external impact.

Furthermore, in the turbo compressor 100, since the air-cooling channels 41 are generated in a helical shape around the first central axis C1, a contact area between the housing 10 and the air contained in the air-cooling channels 41 may be increased and thus the air contained in the air-cooling channels 41 may be rapidly cooled.

In addition, in the turbo compressor 100, since the guide members 42 for guiding directions of flow of the air compressed by the first impeller 21 are provided at an upstream side of the air-cooling channels 41, the air having passed through the diffuser 28 may be changed in directions of flow to an appropriate angle to enter the air-cooling channels 41.

In the turbo compressor 100, the housing 10 includes the inner housing 11 including the motor accommodation space 13, and the outer housing 12 surrounding the inner housing 11, and the air-cooling channels 41 are provided between an outer surface of the inner housing 11 and an inner surface of the outer housing 12. As such, the cooling fins 52 and the air-cooling channels 41 may be easily generated.

Since the turbo compressor 100 further includes the water-cooling channel 51 for circulating the cooling liquid to cool the housing 10, the housing 10 heated by heat generated from the motor 30, the bearings 34, etc. may be cooled.

Furthermore, in the turbo compressor 100, since the water-cooling channel 51 includes the water channels 51*a*, 51*b*, and 51*c* penetrating through the housing 10 to cool the housing 10, compared to a case in which a cooling pipe is separately used, cooling efficiency may be high and the possibility of leakage may be very low.

In addition, in the turbo compressor 100, since the water-cooling channel 51 is provided to exchange heat with the air contained in the air-cooling channels 41, the housing 10 heated by heat generated from the motor 30, the bearings 34, etc. may be cooled and, at the same time, the air flowing in the air-cooling channels 41 may also be cooled.

In the turbo compressor 100, since the air-cooling channels 41 are positioned at an outer side of the water-cooling channel 51 in radial directions of the first central axis C1, the air flowing in the air-cooling channels 41 may be cooled in a water-cooling manner by the cooling liquid contained in the water-cooling channel 51 and, at the same time, be cooled in an air-cooling manner by the air outside the outer housing 12.

In addition, in the turbo compressor 100, since the cooling fins 52 capable of increasing heat exchange efficiency are provided between the water-cooling channel 51 and the air-cooling channels 41, heat exchange efficiency between the air flowing in the air-cooling channels 41 and the cooling liquid flowing in the water-cooling channel 51 may be increased.

Furthermore, in the turbo compressor 100, the water-cooling channel 51 includes a plurality of unit water channels 51*a* extending along the first central axis C1 and spaced apart from each other along the circumferential direction of the first central axis C1, a plurality of rear water channels 51*b* for connecting the rear ends of the unit water channels 51*a*, and a plurality of front water channels 51*c* for connecting the front ends of the unit water channels 51*a*, and is generated in a zigzag shape. As such, a contact area between the inner housing 11 and the cooling liquid contained in the water-cooling channel 51 may be increased as much as possible, and the cooling liquid may uniformly flow throughout the inner housing 11.

Although the cooling fins 52 are integrally generated on the outer circumferential surface of the inner housing 11 in the current embodiment, it will be understood that the cooling fins 52 may also be processed as separate members and then be coupled to the inner housing 11 by using indenting or the like.

Although the air-cooling channels 41 are generated in a coil shape or a helical shape around the first central axis C1 as illustrated in FIG. 7 in the current embodiment, it will be understood that the air-cooling channels 41 may also be linearly generated along the first central axis C1.

Although the bearings 34 are provided as air bearings in the current embodiment, it will be understood that other types of bearings may also be used.

Although a sealing means for airtightness is not described in the current embodiment, it will be understood that various types of sealing means may also be used.

While the present invention has been particularly shown and described with reference to embodiments thereof, it will be understood by one of ordinary skill in the art that various changes in form and details may be made therein without departing from the scope of the present invention as defined by the following claims.

The invention claimed is:

1. A turbo compressor for compressing a gas and supplying the compressed gas to outside, the turbo compressor comprising:

a compression gas inlet for sucking the gas;

a first impeller for compressing the gas sucked through the compression gas inlet;

a second impeller for compressing the gas compressed by the first impeller;

a compression gas outlet for discharging the gas compressed by the second impeller, to outside;

a compression unit comprising compression gas channels connected from the compression gas inlet to the compression gas outlet;

a motor having an end coupled to the first impeller and another end coupled to the second impeller to rotate the first and second impellers, and comprising a rotary shaft extending along a first central axis;

a housing comprising a motor accommodation space to accommodate the motor;

an intercooler comprising air-cooling channels through which the gas flows, and provided on the compression gas channels located between the first and second impellers, wherein the air-cooling channels penetrate through and are hidden in the housing; and a water-cooling channel for circulating a cooling liquid to cool the housing, wherein the water-cooling channel comprises:

a plurality of unit water channels extending along the first central axis and spaced apart from each other along a circumferential direction of the first central axis;

a plurality of rear water channels for connecting rear ends of the unit water channels, the rear water channels being extended in the circumferential direction of the first central axis; and a plurality of front water channels for connecting front ends of the unit water channels, the front water channels being extended in the circumferential direction of the first central axis, such that the entire water-cooling channel is formed in a zigzag shape along the circumferential direction of the first central axis and surrounds a whole inner wall of the housing, wherein the water-cooling channel is provided to exchange heat with the gas contained in the air-cooling channels, wherein the air-cooling channels are positioned at an outer side of the water-cooling channel in radial directions of the first central axis.

2. The turbo compressor of claim 1, wherein the air-cooling channels are generated in a helical shape around the first central axis.

3. The turbo compressor of claim 1, wherein guide members for guiding directions of flow of the gas compressed by the first impeller are provided at an upstream side of the air-cooling channels.

4. The turbo compressor of claim 1, wherein the housing comprises:

an inner housing comprising the motor accommodation space; and an outer housing surrounding the inner housing, and wherein the air-cooling channels are provided between an outer surface of the inner housing and an inner surface of the outer housing.

5. The turbo compressor of claim 1, wherein the water-cooling channel comprises water channels penetrating through the housing to cool the housing.

6. The turbo compressor of claim 1, wherein cooling fins capable of increasing heat exchange efficiency are provided between the water-cooling channel and the air-cooling channels.

* * * * *